137-13
8/12/80 XR 4,216,800 SR

United States Patent [19]
Garnier et al.
[11] 4,216,800
[45] Aug. 12, 1980

[54] PROCESS AND DEVICE FOR THE CONTROL OF LIQUID METAL STREAMS

[75] Inventors: Marcel A. Garnier, Grenoble; Rene J. Moreau, Voiron, both of France

[73] Assignee: Agence Nationale de Valorisation de la Recherche (ANVAR), Neuilly sur Seine, France

[21] Appl. No.: 923,378

[22] Filed: Jul. 10, 1978

[30] Foreign Application Priority Data

Jul. 12, 1977 [FR] France ..... 77 21513

[51] Int. Cl.³ ..... F15D 1/00; B22D 11/16; B22D 27/02

[52] U.S. Cl. ..... 137/807; 137/827; 137/13; 164/49; 164/147

[58] Field of Search ..... 137/13, 251, 827, 807, 137/DIG. 10; 222/590, 591, 594; 164/48, 49, 146, 147

[56] References Cited

U.S. PATENT DOCUMENTS

| | | | |
|---|---|---|---|
| 2,686,864 | 8/1954 | Wroughton et al. | 164/65 X |
| 3,218,681 | 11/1965 | Ditto | 164/147 X |
| 4,016,926 | 4/1977 | Yamada et al. | 164/49 X |
| 4,033,398 | 7/1977 | Laithwaite | 164/49 |
| 4,146,078 | 3/1979 | Rummel | 164/147 X |

FOREIGN PATENT DOCUMENTS

| | | |
|---|---|---|
| 1296410 | 7/1961 | France . |
| 1576364 | 12/1967 | France . |

*Primary Examiner*—William R. Cline
*Attorney, Agent, or Firm*—William D. Stokes

[57] ABSTRACT

The invention concerns the centering, the guiding and the correction of shape of liquid streams of different metals. A series of various and different electrical conductors A, B, C, D, even in number, are disposed along generatrices of a prism whose axis X coincides with the axis to be imposed on stream V. High frequency alternating currents opposite in direction are passed along two successive conductors. Application to different types of casting in particular.

11 Claims, 14 Drawing Figures

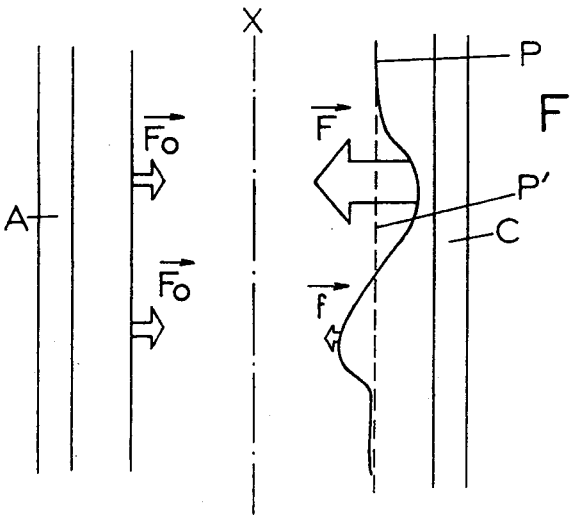
Fig.7
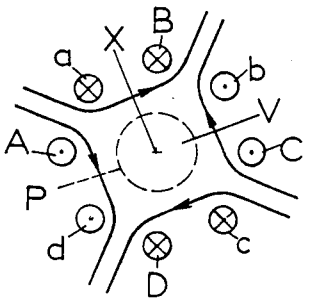
Fig.8.
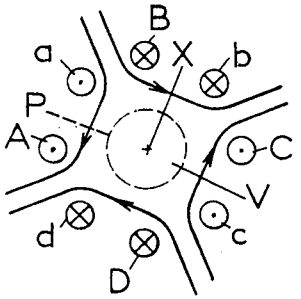
Fig.9.
Fig.10.
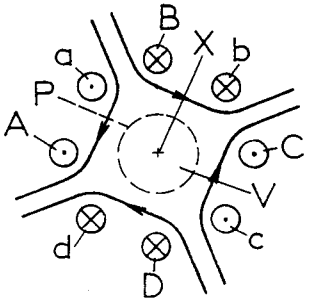
Fig.11.

Fig.12.
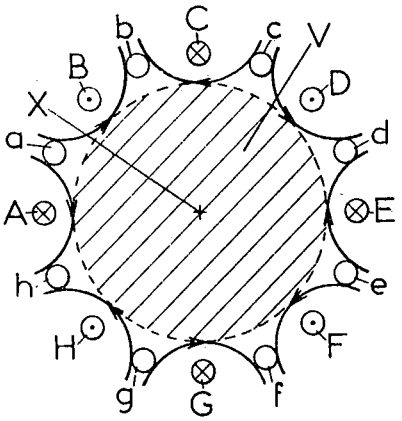
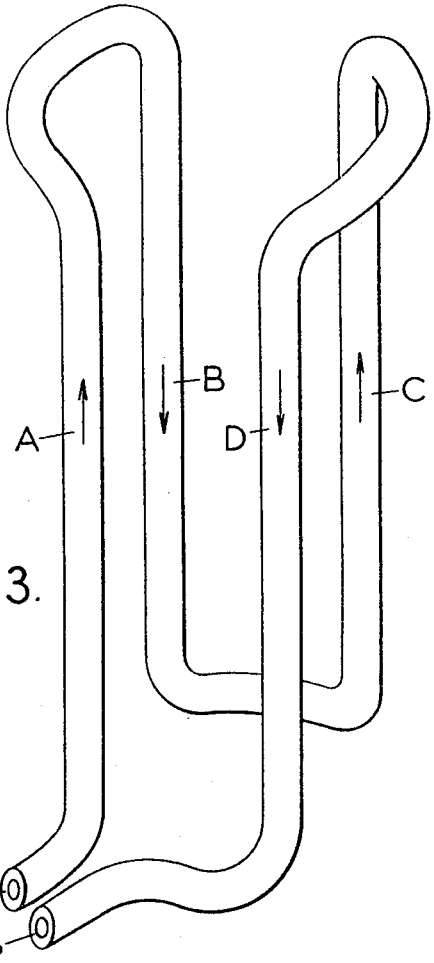
Fig.13.
Fig.14.
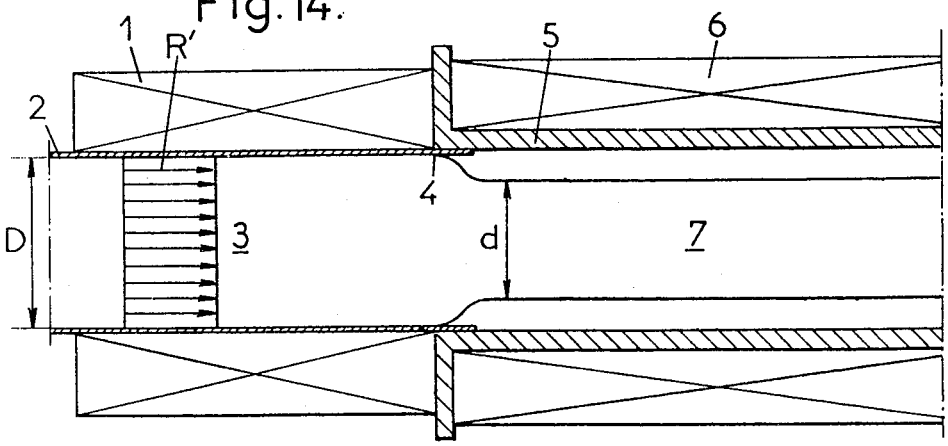

PROCESS AND DEVICE FOR THE CONTROL OF LIQUID METAL STREAMS

FIELD OF THE INVENTION

The invention relates to the control of liquid metal currents, jets, or streams, particularly in order to centre them, to guide them or to impose a circular section to the stream, without using walls for channelling these streams.

It can be applied to all metals, particularly aluminum, steel, copper, uranium and precious metals, as well as to their alloys, in the liquid state.

BACKGROUND OF THE INVENTION

The absence of walls eliminates the problems which usually appear during contact between the liquid metal or alloy and these walls. Such contact causes, on the one hand, chemical pollution of the liquid metal from the refractory materials which form the walls and, on the other hand, physical pollution by the formation in their vicinity of dendrides or large sized particles which greatly impair the quality of the metal obtained. The risk of clogging or erosion of the walls are of course also removed. If desired, the directing or the channelling of the liquid streams may be carried out in a controlled atmosphere.

The invention lends itself to numerous applications: batch, semi-continuous or continuous casting, continuous formation of small diameter billets or metal wires, detachment of a liquid stream from the walls which surround it.

SUMMARY OF THE INVENTION

It consists:

As far as the process is concerned, in subjecting a liquid metal stream to at least one multipolar rotating magnetic field of high frequency for creating induced currents in the skin of said stream, the geometry of this field being such that its amplitude increases greatly from a line or zone where it is minimal which causes the longitudinal axis of said stream to align with said line or zone;

In so far as the device is concerned, in providing this latter with a series of electrical conductors, even in number, disposed generally along generatrices of a prism or cylinder whose axis, rectilinear or curvilinear, coincides with the longitudinal axis to be imposed on the liquid metal stream, and means for causing, at a given moment, high frequency alternating current, opposite in direction, to pass along two successive conductors following the periphery of said prism or cylinder; there may further be provided a second series of electrical conductors, also even in number, disposed alternately with the conductors of the first series along generatrices of said prism or cylinder, and means for causing, at a given moment, high frequency alternating currents, opposite in direction, to pass along two successive conductors, following the periphery of said prism or cylinder, of the second series; in the case where there are two series of conductors, even in number, the frequencies of the currents passing along the conductors of the two series may be different.

The invention will, in any case, be well understood with the help of the complement of description which follows as well as the accompanying drawings, which complement and drawings are, of course, given solely as examples of embodiments.

DESCRIPTION OF THE DRAWINGS

FIG. 7 is a section passing through said axis and applying in the case where there are two series of conductors and where the frequencies of the alternating currents which flow in the conductors of both series are different.

FIGS. 8 to 11 are sections perpendicular to said axis, in the case shown in FIG. 7, corresponding to four successive moments separated by a period of time depending on the difference between the two above-mentioned frequencies.

FIG. 12 illustrates, in section perpendicular to said axis, the case of a large number of conductors divided into two series.

FIG. 13 shows, in perspective, one way of providing a series of conductors capable of being supplied from a single high frequency AC source, so that in two peripherally successive conductors there flow, at any given moment, currents opposite in direction.

FIG. 14, finally, shows in section along the channelling axis, a device for reducing the section of the liquid metal stream and for detaching it from the walls which guide it upstream.

DETAILED DESCRIPTION OF THE PREFERRED EMBODIMENTS

According to the invention and more especially according to those of its modes of application, as well as those embodiments of its different parts, to which it seems preference should be given, with the intention for example of directing a liquid metal stream in order particularly to center it, guide it or correct the shape thereof, the following or similar is the way to realize it.

First of all it is recalled that any electricity conducting liquid, in particular a liquid metal stream, subjected to an alternating magnetic field is the seat of induced electric currents having a geometry similar to that of the inducing currents generating the magnetic field and in phase opposition therewith. If the frequency of the magnetic field is high, these induced currents are located at the periphery of the liquid field. In this superficial "skin", the thinner the higher the frequency, the interaction between crossed induced currents and the magnetic field give rise to Laplace forces always directed towards the inside of the liquid field; they are therefore centripetal in the case of a cylinder. The strength of the Laplace forces is proportional to the square of the strength of the magnetic field existing at the free surface of the liquid metal.

It is from this important result that is derived the possibility of centring or guiding a metal flow in the complete absence of walls, by implementation of the invention. To compel a metal flow not to diverge from a given position, a system of return biasing forces is created which tends to bring it back to the desired position when it moves away therefrom; there is then created a set of forces whose strength is all the higher the further away from this position. We tend then to create a magnetic field whose amplitude (so the square of the amplitude) increases greatly from a singular line where it is minimal: any movement which might tend to move the axis of a liquid metal current or stream from this singular line would then be greatly impeded by the action of the electromagnetic forces. If this singular line is rectilinear, centering is achieved. To obtain guidance, this singular line is given the form which it is desired to see adopted by the axis of the metal stream. The region in which the magnetic field increases greatly from a singular line will be called hereafter "potential hole".

There will now be described with reference to FIGS. 1 to 12 how, according to the invention, "potential holes" are provided to effect centering or guiding of liquid metal streams.

Figure 1:
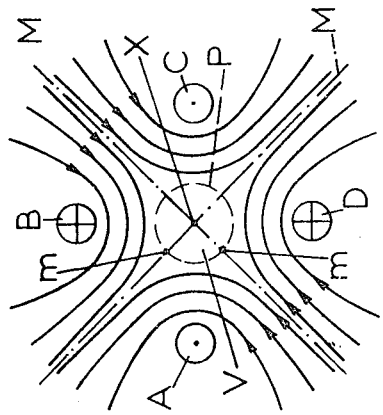
Figure 6:
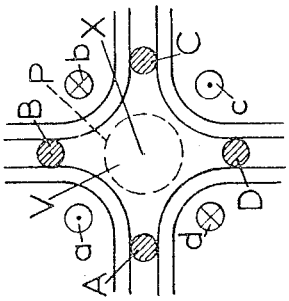
FIGS. 3 to 6 show an embodiment of the invention in the case of two series of conductors, the figures, in section perpendicular to said axis, corresponding to four successive moments separated by quarters of a period (of the high frequency alternating current which flows in the conductors of both series).
Figure 5:
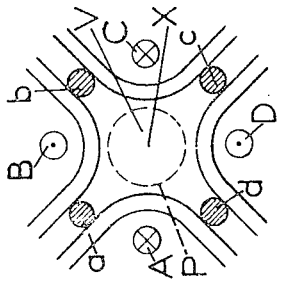
Figure 4:
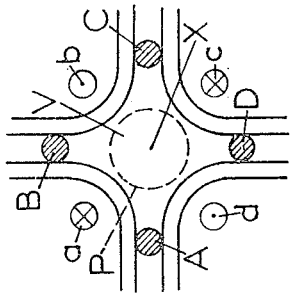
Figure 3:
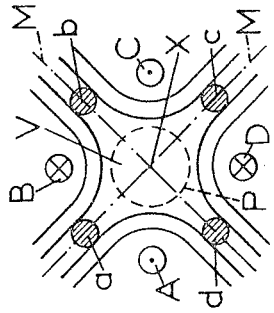

Suppose a system formed from four rectilinear conductors A, B, C, D disposed along the main generatrices of a cylinder (or prism) having a square base and through which flow high frequency AC currents in phase opposition in two successive conductors, as illustrated in FIG. 1. In this figure, there is shown by a cross the currents penetrating, at a given moment, the surface of the paper and by a dot the current which, at the same moment, come out of this surface.

The magnetic field resulting from the presence of the four conductors A, B, C, D is zero along axis X of the cylinder and greatly increases as we move closer to the conductors, so as we move away from this singular line. In FIG. 1 there is shown by arrows the direction of the magnetic field on lines along which the square of the amplitude of the magnetic field is constant.

Figure 2:
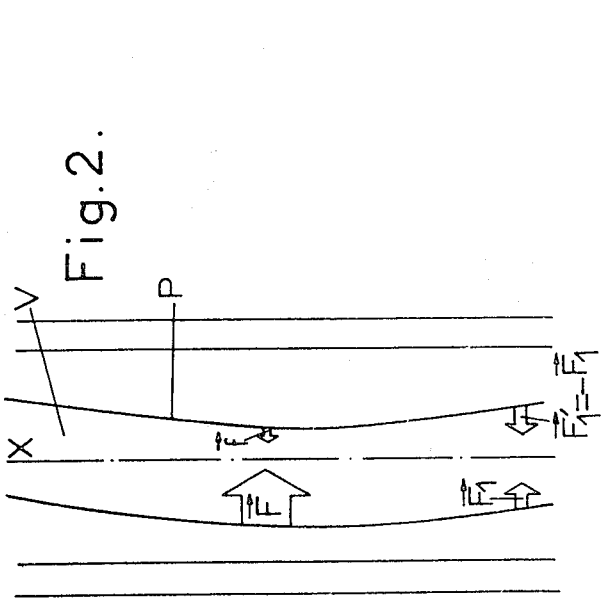
FIGS. 1 and 2 are two sectional diagrams, respectively perpendicular to the line to be imposed on the liquid metal stream and along this line (which is assumed rectilinear) illustrating the invention in the case of a single series of conductors.

Suppose a liquid metal stream V of circular section flowing inside the "potential hole" with axis X provided in this way; if the axis of the liquid stream does not correspond to that of the potential hole, the resultant of the electromagnetic forces which are exerted in the electromagnetic skin of the stream is not zero and tends to bring the two axes into coincidence achieving centering of the metal stream. This is illustrated in FIG. 2 in which it can be seen that everything happens as if liquid metal stream V were imprisoned in an elastic jacket, i.e. the electromagnetic skin, which opposes any displacement and any deformation which might destroy the symmetry in relation to axis X of the "potential hole". In FIG. 2 there is shown, by arrows F, f, $F_1$, $F_1'$, the return forces, the size of each arrow representing the strength of the corresponding force.

In fact, besides axis X of the cylinder, there exists, at the periphery P of the metal stream, four other singular lines m having zero magnetic field, corresponding to the intersection of the free surface P of the liquid metal with the intermediate planes M of the faces of the cylinder. Along these lines m no electromagnetic force may oppose possible displacements of the liquid metal.

It is not possible, with the configuration of the magnetic field of FIG. 1, to cause these singular lines m to completely disappear. However the association of four conductors a, b, c, d, similar to conductors A, B, C, D and following geometrically therefrom by a rotation of 45° about the axis of cylinder X and electrically by a phase shift of a quarter of a period, allows the substitution, twice per period, of regions where the return forces are maximum for those where they are non-existent. This is illustrated in FIGS. 3 to 6, corresponding to moments 0, T/4, T/2 and 3T/4 respectively (T is the period of the alternating current which flows in the conductors). The significance of the dots and the crosses is the same as for FIG. 1. The hatching represents zero currents. Taking into account the high frequency of the currents, which is of the order of several tens of kilohertz, and the inertia of the liquid metal, the very rapid deviation of the singular lines at the surface of the liquid metal amounts to the creation at every point of the surface of a return force, on the average constant and capable of maintaining the cylindrical shape of the metal section. This device allows not only centering or guiding to be achieved but also has the advantage of correcting possible surface defects which appear as deviations from the circular position centred on axis X of the potential hole, by the play of the differential forces of this return system.

In FIG. 7, similar to FIG. 2, but corresponding to two series of conductors A, B, C, D and a, b, c, d, there are shown the different return forces F, $F_o$ and f having strengths proportional to the size of the arrows which represent them; the effective periphery P of stream V is shown by continuous lines whereas the ideal periphery P' is shown by dashed lines.

In so far as low speed metal streams are concerned, the system described above with reference to FIGS. 3 to 6, which causes the singular lines of the magnetic field to rotate on the surface of the liquid stream, may cause a phenomenon of setting in rotation the metal stream which becomes a liquid rotor in the stator formed by the eight conductors A, B, C, D and a, b, c, d.

It is possible to remedy this disadvantage by suppling each of the two series formed by the four conductors A, B, C, D and a, b, c, d at different frequencies $f_1$ and $f_2$ (with for example $f_2 > f_1$), the inducting currents being of the same amplitude. The rotation of the singular lines then becomes reversible. In a reference system tied to the magnetic field having a frequency $f_1$, the reversal frequency of the direction of rotation of the potential hole is $f_r = 2(f_2 - f_1) = 1/Tr$. In such a reference system, $\frac{1}{8}$ of a revolution is effected during Tr/2, which gives the number n of revolutions effected in a fixed reference system $$n = \frac{f_1 + f_2}{8(f_2 - f_1)}$$

In FIGS. 8 to 11, there is shown, at successive moments 0, Tr/2, Tr, 3Tr/2 the direction of the currents in the two series of conductor A, B, C, D (first series) and a, b, c, d (second series) and the directions of the magnetic fields. A suitable choice of frequencies $f_1$ and $f_2$ provides an electromagnetic skin having a reduced maximum thickness $\phi max$ with regard to the radius of the metal stream and determines the number n of revolutions accomplished before the reversal of the rotational direction of the potential hole.

For example:

| | |
|---|---|
| $f_1$ = 15000 Hz | $f_2$ = 25000 Hz |
| Fr = 20000 Hz | n = $\frac{1}{2}$ |

$\phi max = (2/\pi\mu\sigma f_1)^{1/2} = 5{,}10^{-3}$m, for a steel for which $1/\sigma = 160{,}10^{-8}$mho/m, $\mu$ being the magnetic permeability of the liquid metal which is equal to that of a vacuum.

Such a device allows then any risk of twisting of the metal stream to be eliminated in the case where the transit time of the liquid particles inside the potential hole is not small.

Another solution for avoiding the setting in rotation of the liquid stream consists in supplying each of the two series formed by four conductors A, B, C, D and a, b, c, d through electrical "choppers" in the following way: the electric current is supplied for a period of time $T_1$ to the series A, B, C, D; at the end of this period of time the current is supplied to the series a, b, c, d for a period of time $T_2$, then this current is again supplied for a period of time $T_1$ to series A, B, C, D and so on. A rotation of an eighth of a revolution of the configuration of the magnetic field is thus obtained with a reversal frequency $f_o = 1/T_o$ wherein $T_o = T_1 + T_2$. The periods of time $T_1$ and $T_2$ must be selected so that the "skin" thickness corresponding to frequency $f_o$ is very low with regard to the radius of the liquid metal stream.

This arrangement of an electrical nature for obtaining rotation, reversible or not, of the singular lines of the magnetic field presents the great advantage of having no moving part. Mechanical methods not having such an advantage may however be used to produce the same effect : in this case, the device for creating the "potential hole" formed by a single series of conductors must be driven as a whole with a rotational movement or with an oscillating movement about its axis by a suitable outside device (e.g. motor, torsion bars . . .).

In each of the examples of devices given above, the initial potential is formed with a series of four rectlinear parallel conductors through which passes a high frequency alternating current, a second series of four conductors in which flows a current at the same frequency or at a different frequency serving to improve the operation in certain cases.

For liquid metal streams of large diameter, such a device cannot perfectly fulfil the roles of centring, guiding and/or correcting the shape, because of the necessary remoteness of the conductors. The effect produced on an initially circular stream having a large diameter would lead to a configuration close to that of the field lines and so the stream would develop towards a section close to a square with a system formed having four conductors (FIGS. 1 and 2) or close to an octagon in the case of two series of four conductors (FIGS. 3 to 11). To maintain the section of the stream circular, it will be necessary to increase up the number of conductors forming the potential hole, while respecting the condition of phase opposition of the electric currents in two successive conductors of the system creating the potential hole. Furthermore, for an initial system of 2N conductors (N being a whole number), a rotation of the potential hole, reversible or not, may be obtained by associating a system identical to the first following from this latter by a rotation through an angle $\pi/4N$ about the axis of the potential hole. The rotation, continuous or reversible, of the configuration of the magnetic field may be obtained by using the above-described electrical or mechanical means.

In FIG. 12 there is thus shown a system having eight conductors A, B, C, D E, F, G, H to create the potential hole (first series of conductors) and eight conductors a, b, c, d, e, f, g, h forming the second series.

In FIG. 13 there is shown how to form in practice a series of four conductors for creating a potential hole and through which there must therefore pass an alternating current of the same high frequency, the direction of the current having to change from one conductor to the adjacent conductor in the peripheral direction. In this figure can be seen the four conductors A, B, C, D and it can be seen that the condition of the alternate direction of the currents which flow therethrough is constantly respected. The alternating current is supplied at the ends R, S of the series of conductors.

It will be readily understood that a similar structure may be easily provided having eight conductors. Six, ten twelve conductors or more may also be provided, the number of conductors being always even.

The conductors of the possible second series may be provided in a similar way.

There now follows a classification of the different potential holes with respect to the effect desired.

The potential holes, provided by parallel conductors supplied with an alternating current at a frequency sufficiently high to ensure an electromagnetic skin having a small thickness with regard to the radius of the metal stream on which they are to act, may fulfil the following functions:

(a) Centring of a vertically flowing liquid metal stream.

If the diameter of the liquid metal stream is reduced, this effect is obtained with a system of four conductors supplied so that the electric currents are opposed in two successive conductors. The number of conductors, necessarily even, is increased to obtain the centring of large diameter metal streams.

(b) Guiding and correcting the shape of a liquid metal stream.

The electromagnetic forces must oppose any movement tending to move the axis of the metal stream from the axis of the potential hole which imposes the path which the liquid metal must take. To ensure the existence of such forces over the whole surface of the metal stream, it is necessary to associate a second series of conductors with the one used for centring. This association destroys by rotation the localization of the singularities by rotation. A phase shift of a quarter of a period between the two series supplied at the same frequency is sufficient to guide high speed metal streams which may not be affected by the rotation. On the other hand, supplying two series at different frequencies creates a reversible rotation indispensable for avoiding any twisting effect of a low speed metal stream or of a liquid metal stream having to be guided over great lengths. In addition to guiding, the device of the invention reduces the deformation of the free surface which would tend to cause the symmetry of revolution about the axis of the potential hole to disappear.

(c) Centring of a horizontally flowing liquid metal stream.

It is a question here in fact of particular guiding, characterized by the potential hole having a horizontal axis. The electromagnetic forces generated in the lower part of the metal stream are then opposed to gravity so that the liquid metal is only subjected to horizontal inertial forces.

Moreover, it will be noted that the presence of induced currents in the electromagnetic skin heats up the metal by supplying extra energy to the liquid stream, and maintains it in the liquid state during the whole crossing of the potential hole.

The field of industrial applications of the process and of the device of the invention is very vast since they enable centering, guiding and correction of the shape of a liquid metal stream to be obtained without any contact between the liquid metal and the walls usually indispensable to the accomplishment of these operations. The problems of clogging, erosion, pollution of contact with liquid metal or of contamination thereof from the refractory walls are thus completely eliminated. This makes the invention very useful in the metallurgy of precious metals since the absence of walls, on the one hand, and of moving parts on the other, permits the casting to be carried out very simply in a controlled atmosphere, which completely removes the risks of the liquid metal being attacked by its environment and allows a metal of great purity to be obtained needing no other treatment after casting.

The invention may, by way of an example of application, provide an improvement in the batch or semi-continuous casting of series of small parts.

The operation is traditionally carried out in the following way. Different moulds placed on the same chain follow one another below a casting ladle where they are filled with liquid metal. A device for stopping up the aperture of the casting ladle interrupts in general the casting for the time required to remove one mould and to put the next one in place. The precise positioning of the mould and of the casting ladle and the geometric quality of the stream of liquid metal are difficult to obtain and very often lead to a loss of liquid metal which spills over the outside of the mould. The partial clogging up of the casting aperture (generally due to the solidification or accumulation of inclusions along the wall of the aperture) or its rapid erosion, destroy in fact very quickly the symmetry of revolution of the metal stream which then assumes a warped shape, elongated in one direction and may be considerably deflected from the vertical axis on which the mould to be filled is positioned.

A guiding or centering device according to the invention, placed at the outlet of the casting ladle reimparts to the metal stream the cylindrical shape adapted at the inlet to the mould and brings its axis in perfect coincidence with that of the mould to be filled, thus eliminating any anarchic casting of the metal outside the mould.

Each time that it is possible to bring into contact a casting ladle and a mould or an ingot mould, the device of the invention avoids all risk of metal clinging to the walls and all losses of liquid metal owing to its functions of centring and correction of shape.

Centering guiding and re-establishing or maintaining the circular cylindrical shape by use of the invention also find an important application in the continuous casting of billets of small diameter or of wires directly from the liquid metal without the help of any wall. The solidification of the liquid metal maintained in the desired cylindrical shape also simplifies the conventional operations of extrusion or wire-drawing and eliminates the problems associated therewith, particularly plugging.

Another application of the invention is the improvement of the device described in French published patent application 2 316 026filed on July 4, 1975 by the AGENCE NATIONALE DE VALORISATION DE LA RECHERCHE (ANVAR) and the INSTITUT DE MECANIQUE DE GRENOBLE, UNIVERSITE SCIENTIFIQUE ET MEDICALE DE GRENOBLE for "Electromagnetic device for confining liquid metals".("Dispositif électromagnétique de confinement des métaux liquides").

The device described in this patent application allows a liquid metal stream to be detached or separated from the walls which contained it or to suddenly reduce the diameter of a free stream through the combined action of a coil supplied with a high frequency alternating current and a copper shield.

In this prior art device, the metal stream, once contracted by the coil, is subjected to no force of electromagnetic origin which it is the purpose of the shield to cause to disappear. Thus no guiding, no centring of the contracted stream is achieved for this is not the aim of the device of the above-mentioned patent application; the magnetic field created upstream of this screen by the coil is uniform and consequently incapable of causing return forces to appear which are indispensable to the centering or the guiding of a liquid metal stream.

The electromagnetic forces which appear in the skin of a metal stream passing through a potential hole are radial and centripetal and are the cause of an internal overpressure in the liquid metal indentical to that existing when passing through the coil of the prior art device of said patent application. The substitution, for the coil of this device, of a potential hole for guiding, provided by a device according to the invention allows then, with the help of a screen made from a good electricity conducting metal, such as copper, the contraction of a free metal stream to be obtained while still ensuring the centring or the guiding thereof upstream of the contraction which appears at the beginning of the copper screen.

Thus, from a liquid stream 3, flowing in the direction of arrows R' in a channel having walls 2, it is possible in the same way, as shown in FIG. 14, to centre or guide the metal stream 7 contracted or separated at 4 from wall 2 by a device 1 in accordance with the invention; all that is required for this is to place about copper shield 5 a new guiding device 6 in accordance with the invention supplied with electric currents at a frequency such that the magnetic field created passes through the copper thickness and penetrates into the free flowing stream 7 only a short distance. Thus, inside the shield the metal stream is subjected to a system of biasing forces for centering or guiding, in any desired position whatever, even horizontal. The electromagnetic forces exerted on the liquid metal in this region are necessarily the cause of an internal overpressure. This overpressure does not reduce the efficiency, as might be thought, since the assembly of the two devices 1 and 6 allows, for a given supply of device 1, the same coefficient of contraction to be obtained, whether device 6 is present or not.

In fact if $B_1$ is the amplitude of the magnetic field at the surface of the liquid metal in device 1, the resulting overpressure is $B_1^2/2\mu$ which, in the absence of device 6, gives a contraction $\alpha_1 = d/D$ $$\alpha_1 = \left(1 + \frac{B_1^2}{\mu\rho V^2}\right)^{-\frac{1}{2}}$$

$\mu$ and $\rho$ having the same significance as above and d and D being the diameters of the liquid stream after and before contraction respectively (see FIG. 14). The supply frequency of device 6 is such that the copper screen 5 is permeable to the magnetic field $B_2$ created by device 6, whereas it is impermeable to $B_1$. Thus, when device 6 is in operation, magnetic field $B_2$ affects not only the region within the screen but also a limited region located upstream of screen 5. Device 6 contributes therefore to increasing the internal overpressure in the liquid metal upstream of screen 5 by an amount equal to the overpressure which it creates downstream of loosening point 4. Since the coefficient of contraction depends solely on the difference of the pressures within the liquid metal between upstream and downstream of the copper screen 5, the overall contribution of device 6 is zero and the coefficient of contraction is not modified by its presence.

The assembly of FIG. 14 provides the same performance as the device of the above-mentioned patent application. Moreover, it allows the centring or the guiding of the liquid metal stream not only upstream of the loosening point if the stream is free, but beyond this point in the zone protected by the copper screen. Such an assembly possesses the great advantage of being able to operate in a sloping or horizontal position. In addition, if the effect desired is an absence of metal-wall contact, a very low coefficient of contraction is sufficient because of the guiding of the contracted stream which eliminates any risk of unwanted contact downstream of the loosening point, consequently limiting the power to be supplied to devices 1 and 6.

We claim:

1. A device for centering, guiding and/or imparting a circular section to an unconfined liquid metal stream by subjecting said stream to at least one high frequency multipolar rotating field for creating induced current only in the skin of said stream, the geometry of this field within said stream being such that its amplitude increases greatly from a line or zone toward said skin where it is minimal, so that the longitudinal axis of said stream aligns itself along with said line or zone controlling said stream without using physical walls comprising; a series of at least four electrical field generating means even in number, disposed generally equally along generatrices of a prism or cylinder whose axis, rectilinear or curvilinear, coincides with the longitudinal axis to be imposed on said liquid metal stream, and means for passing, at least during certain periods of time, high frequency alternating currents opposite in direction along two successive field generating means, following the periphery of said prism or cylinder.

2. The device according of claim 1, comprising a second series of at least four electrical field generating means, also even in number, disposed alternately with the field generating means of the first series along generatrices of said prism or cylinder, and means for passing, at least during certain periods of time, high frequency alternating currents opposite in direction along two successive of said generating means of this second series, following the periphery of said prism or cylinder, of the second series.

3. The device according to claim 2, wherein the frequencies of the current passing along the field generating means of both series are different.

4. The device of claim 2 comprising means for alternately supplying, for periods of duration $T_1$ and $T_2$, the field generating means of the first series and the field generating means of the second series.

5. The device according to claim 2, wherein the assembly of the field generating means of both series forms the edge of a right prism whose base is formed by a regular polygon having a number of sides which is a multiple of four.

6. The device of claim 1, wherein the first or sole series of conductors forms the edge of a right prism whose base is formed by a regular polygon having an even number of sides.

7. A device of claim 6, wherein the polygon is a square.

8. The device according to claim 6, wherein the polygon is an octagon.

9. The device according to claim 1, wherein the field generating means of one series or of the series of field generating means are formed from a single conducting element folded a number of times in hairpins between two field generating means operating successively on the periphery.

10. A device for contracting a liquid metal stream, comprising a device according to claim 1 and a tubular shield made from a good electricity conducting metal, such as copper, said shield being disposed in continuation of this latter device starting from the place where it is desired to obtain the contraction and coaxially thereto.

11. A device according to claim 10, which further comprises a second device according to claim 1 disposed about said tubular shield.

* * * * *